US005249324A

United States Patent [19]

Giammanco et al.

[11] Patent Number: 5,249,324

[45] Date of Patent: Oct. 5, 1993

[54] ADJUSTABLE WHEEL ASSEMBLY FOR POOL VACUUMS

[75] Inventors: Angelo J. Giammanco; John W. Dulin, both of Palatka, Fla.

[73] Assignee: A. J. Giammanco & Associates, Inc., Palatka, Fla.

[21] Appl. No.: 922,247

[22] Filed: Jul. 31, 1992

[51] Int. Cl.[5] ..... E04H 3/20

[52] U.S. Cl. ..... 15/1.7; 15/354; 280/43.17

[58] Field of Search ..... 15/1.7, 354, 52.1, 41.1; 280/43, 43.17

[56] References Cited

U.S. PATENT DOCUMENTS

| | | | |
|---|---|---|---|
| 1,900,692 | 3/1933 | Clements | 15/354 |
| 2,915,318 | 12/1959 | Chesser | 280/43 |
| 3,000,647 | 9/1961 | Fox | 280/43.17 |
| 3,421,776 | 1/1969 | McCoy et al. | 280/43.17 |
| 3,649,828 | 3/1972 | Price | 280/43.17 |
| 3,805,309 | 4/1974 | Levack | 15/1.7 |

FOREIGN PATENT DOCUMENTS

| | | | |
|---|---|---|---|
| 2023593 | 11/1971 | Fed. Rep. of Germany | 15/1.7 |

*Primary Examiner*—Edward L. Roberts
*Attorney, Agent, or Firm*—Arthur G. Yeager

[57] ABSTRACT

An adjustable wheel assembly for varying the height of a pool vacuum head above the bottom surface of a pool includes a wheel mounted rotatably on an axle which is in turn mounted on a pair of axle mounts to the body of the vacuum head. The axle mounts themselves are also rotatably mounted between a pair of spaced arm members. The axle is mounted spaced away from the axis of rotation of the axle mounts in a manner to vary the vertical position of the axle with respect to the body as the axle mounts are rotated. A cooperating tab and notch arrangement secures the axle mounts into a selected position to prevent rotation of the axle mounts during normal use of the pool cleaning apparatus.

20 Claims, 2 Drawing Sheets

ADJUSTABLE WHEEL ASSEMBLY FOR POOL VACUUMS

BACKGROUND OF THE INVENTION

1. Field of the Invention

The present invention relates to height adjustment apparatus for wheel assemblies and particularly to wheel height adjustment apparatus for use in pool vacuum equipment.

2. Prior Art

Pool vacuum equipment such as suction heads and associated apparatus is, of course, well known in the art. An example is the vacuum cleaner head in U.S. Pat. No. 4,376,320 which, however, has no means for varying the height of the head above the bottom surface of a pool. Generally speaking, a user will prefer the head be higher when using the device to clean vinyl flooring pools as compared to concrete pools where the suction cannot damage the pool. The '320 patent thus requires a variety of (1) different heads for different pools and (2) different suction equipment that may vary widely from pool to pool. See also U.S. Pat. No. 5,033,149 which provides a means to vary the height of the head but requires specially configured frame members on the head of two different types. Such an approach can be quite expensive and the particular approach used is also time-consuming.

Other height adjustment equipment includes very complex apparatus that is expensive and time consuming such as that disclosed in U.S. Pat. Nos. 2,776,446; 2,784,441; 2,836,430; 2,894,761; and 3,334,911, none of which are satisfactory.

What is desired is a height adjustment assembly that can be operated quickly and without the use of special tools. Furthermore, the assembly should be inexpensive and simple so as to reduce the possibility of the parts being jammed by debris as could easily happen with the excessive apparatus used in the prior art. Finally, the height adjustment apparatus should provide for adjustments in small increments and each wheel should be independently adjustable to allow a more customized height setting for a particular use. None of the prior art assemblies meet all of the above requirements.

SUMMARY OF THE INVENTION

In one aspect of the present invention there is provided an adjustable height assembly for pool vacuum apparatus comprising a body with a lower surface, a plurality of wheels having a circumferential surface and being carried by the body for supporting the lower surface a selected distance above a bottom surface of a pool, wheel mounting means attached to the body for mounting each wheel to the body including an axle having opposite end portions with a wheel being located therebetween and movable axle mounting means for supporting the axle. Selective locking means for locating the axle mounting means to the body in a manner to selectively inhibit rotary movement of the axle mounting means from a selected position until another position is selected is also provided to adjust the distance between the lower surface and the circumferential surface when each wheel is on a bottom surface of a pool. The axle mounting means includes a pair of spaced axle mount members which are rotatable about a first axis and have a passageway therethrough with a centerline parallel to and spaced away from the first axis for carrying respective end portion of the axle, each pair of axle mount members being rotatable for adjusting the position of a respective said wheel with respect to the body. The body includes a plurality of pairs of spaced arm members extending laterally forwardly and rearwardly therefrom in the general direction of rolling movement of the body on the wheels, each being mounted between a corresponding pair of spaced arm members. Each arm member includes a second passageway therethrough and the axle mount members are located therein. Selective locking means includes a tab and a plurality of cooperating notches. The tab is located on one of the mount members and arm members and the notches are located on the other. The tab is located on each said arm member and is disposed inwardly in the second passageway. Each axle mount member has a perimeter and the notches spaced thereon are sized to engage the tab therein to inhibit rotary movement of the axle mount in a selected position during rolling movement of the body on the wheels. The arm member includes a deformably resilient portion located adjacent the tab for positioning the tab inwardly into a respective selected notch to inhibit rotary motion of an axle mount from a selected position and being deformable outwardly to allow disentanglement of a notch and the tab when the axle mount is forcibly rotated to another selected position.

In another aspect of the present invention there is provided an adjustable height assembly for the wheels of a pool vacuum comprising a body carried on a plurality of spaced axles, a plurality of pairs of spaced apart arm members secured to the body and extending forwardly and rearwardly thereof, elongated axle members having opposite end portions sized for the mounting of the respective wheels thereon between the opposite end portions and between a pair of respective spaced arm members, a pair of axle mounts each having an axis for carrying each axle which is secured to respective end portion of the axle and about which the axle mount may be rotated. Means for rotatably mounting each axle to respective arm member is included, said axle having a rotatable axis parallel with and spaced away from the axis of the axle mount, the means for rotatably mounting the axle including selective locking means for securing the axle mount in a selected position to inhibit rotation of the axle mount during rolling movement of the body on the wheels. The selective locking means includes a tab and a plurality of cooperating notches, the tab being located on one of the mount members and arm members and the notches being located on another of the arm members and mount members. The arm member includes a second passageway therethrough with the axle mount members being located therein.

In another aspect of the present invention there is provided an adjustable height assembly for pool vacuum apparatus having a body and a plurality of wheels carried by the body for supporting the bottom surface of the body a selected distance above a bottom surface of a pool. The assembly comprises wheel mounting means for mounting each wheel to the body, the mounting means including an axle having opposite end portions for carrying the wheel therebetween and movable axle mounting means for supporting the axle. Selective locking means is provided for mounting the axle mounting means to the body in a manner to selectively inhibit rotary movement of axle mounting means from a selected position. The axle mounting means includes a pair of spaced axle mounts which are rotatable about a first axis with a passageway therethrough having a centerline parallel to and spaced away from the first axis for carrying a respective said end portion of the axle for adjusting the position of a wheel with respect to the body by the rotation of a pair of the axle mounts. In other aspects there is provided a body including a plurality of pairs of spaced arm members extending laterally outwardly therefrom, each wheel being mounted between a corresponding pair of spaced arm members. The arm member includes a second passageway therethrough with the axle mount being located therein. The selective locking means includes a tab and a plurality of cooperating notches, the tab being located on one of the arm members and the notches being located on the axle mounts.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 2:
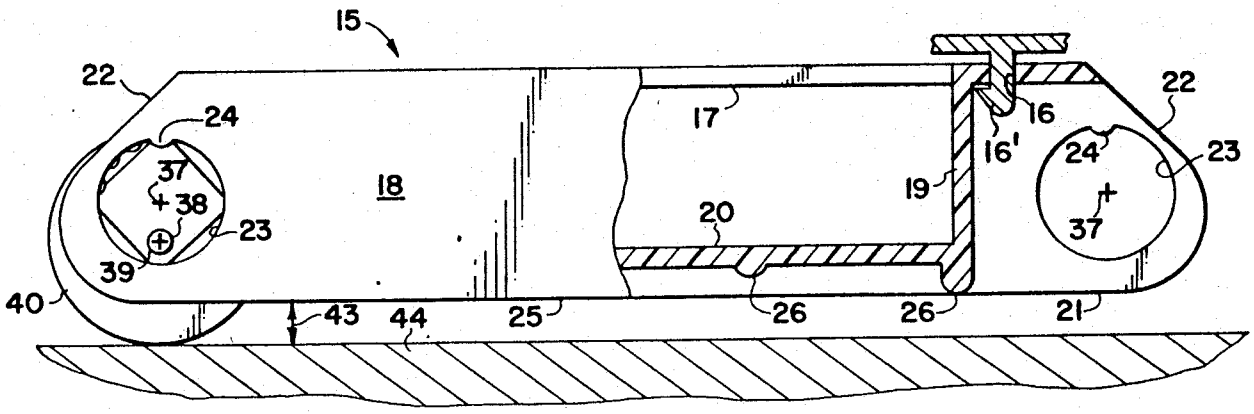
FIG. 2 is a side view of a typical roller frame member in partial cross-section to illustrate the physical position of the wheel assembly of FIG. 1.

With reference now to the drawings, a typical pool vacuum body or head is depicted generally at numeral 10. The main body 11 is molded from plastic and includes a vacuum hose outlet 12 and a handle mount 13. Flanges 14 are ,molded thereon or added later to provide for rigidity as well as a means to mount weights (not shown) or other apparatus. Roller frame members 15 may be formed integrally with the head body 11 or formed separately and mounted upon the body 11 by way of screws, bolts, glue or whatever means are appropriate in the circumstances. FIG. 2 illustrates, in partial cross-section, a single roller frame assembly 15 that is symmetrical about a centerline slot 16 used to secure the tab 16[1] of a weight cover (not shown). A weight compartment 17 is used for weights which are used to counteract the natural buoyancy of the plastic used in the body 11 and assemblies 15. The assembly 15 is further defined by sidewalls 18, end walls 19, bottom wall 20 and a pair of spaced arm members 21 at each end thereof. As will be described in more detail hereinbelow, each arm member 21 includes a deformably resilient portion 22 and a passageway 23 cut therethrough. A tab 24 is integral with the passageway 23. The assembly 15 also has a lower surface 25 defining the point of the assembly that is closest to a pool bottom 44. Structural ribs 26 are used to provide rigidity as well as to provide an interface with the surface of the body 11 if the assembly 15 is manufactured separately as is sometimes the case.

Figure 3:
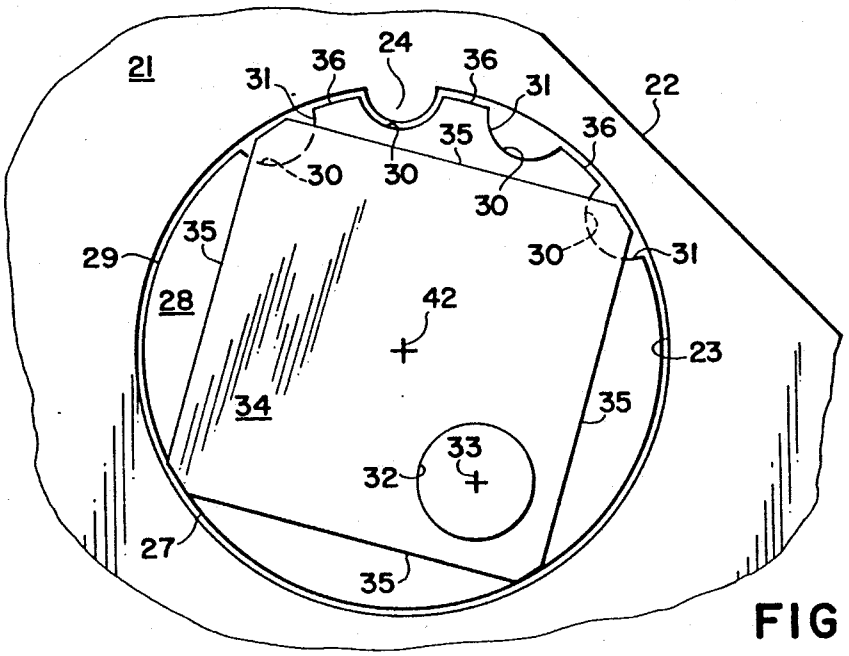
FIG. 3 is an enlarged right side elevational view of a portion of the frame member illustrating the structure of the axle mount of the wheel assembly of FIG. 1.

FIG. 3 illustrates in enlarged detail an axle mount 27 which includes a body 28 having a generally circular perimeter 29 with notches 30 formed therein which have a surface 31. An axle passageway 32 is formed through the body 28 and has a centerline axis 33. The body 28 also includes an integrally formed laterally extending boss or protrusion 34 which is generally square in shape having four sides 35. Arm members 21 have a passageway 23 formed therein with a centerline or axis 37 which is in alignment with the centerline axis 42 of the axle mount 27. Axle 38 has an axis 39 in centerline axis 42 of the axle mount 27. Axle 38 has an axis 39 in line with the centerline axis 33 of the axle passageway 32. This arrangement provides that the axle 38 will move as axle mount 27 is rotated using a handtool as hereinafter described.

Notches 30 are further defined by axle mount body portions 36 and as is clear from the drawing, forcible, rotation of axle mount 27 is required to force tab 24 outwardly in order to align the tab 24 with another notch 30 from a position involving a first notch. Tab 24 is movable by contact with body portion 36 because a portion 22 is deformable outwardly a sufficient amount to allow rotary movement of axle mount 27.

Figure 1:
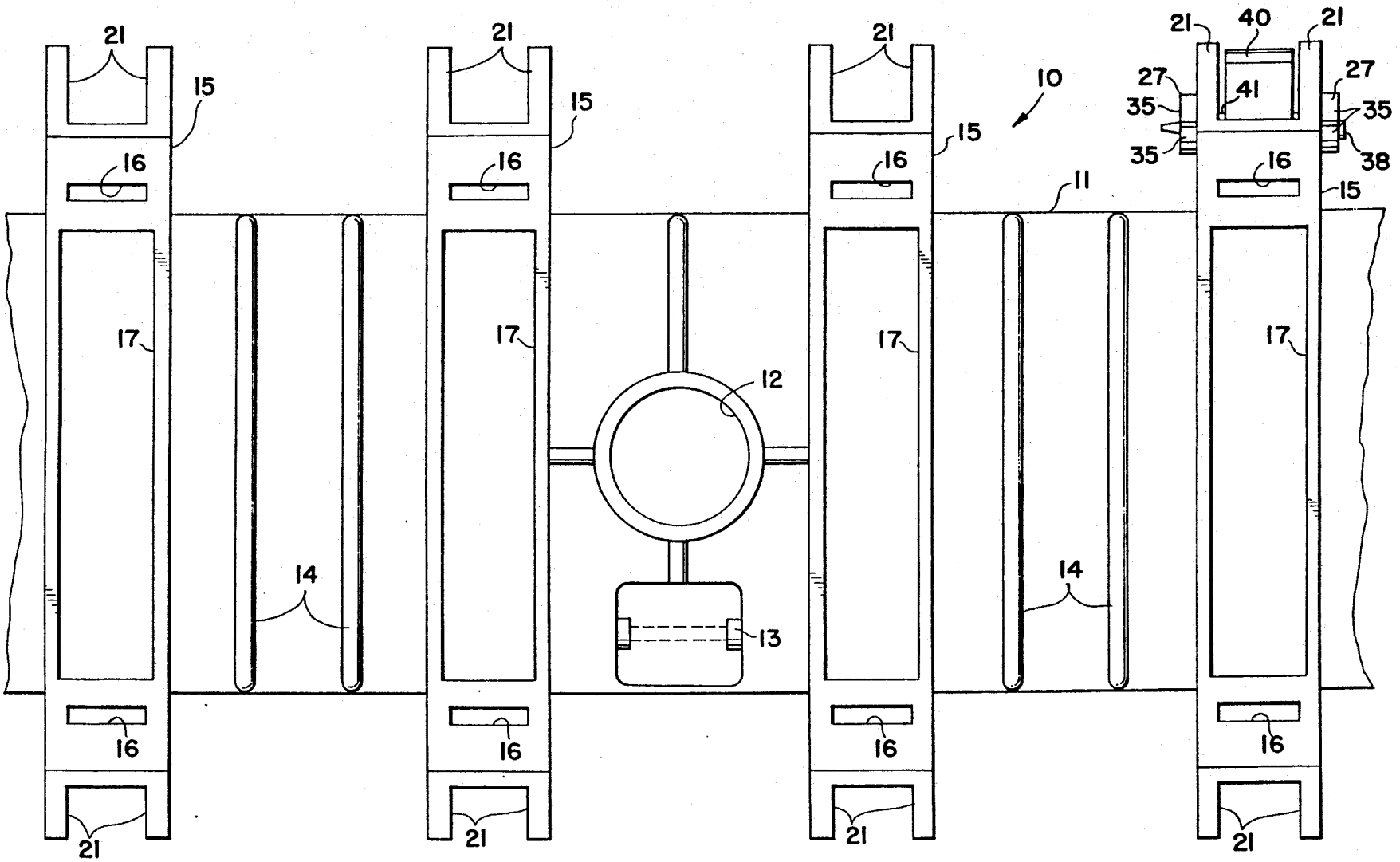
FIG. 1 is a top plan view of a typical pool vacuum head having a plurality of integral roller frame members one of which employs an adjustable wheel assembly in accord with the present invention.

Wheel 40 is mounted around bushing 41 onto axle 38 (as shown in FIG. 1). Accordingly, rotary movement of axle mount 27 will result in movement of the axle 38 thereby adjusting the height of the wheels' axis of rotation with respect to the assembly member 15. More specifically, rotary movement of axle mount 27 will increase or decrease the distance 43 between assembly bottom surface line 25 and the pool surface 44.

In the preferred embodiment of the present invention, the axle mount 27 has four notches 30 extending over a 90 degree quadrant of the mount perimeter 29. Tab 24 is preferably located at the 12 o'clock position and accordingly, the wheel 40 can be adjusted to four different heights. It is to be understood that more or fewer adjustments may be incorporated for a particular wheel height adjustment assembly.

In the preferred embodiment of the present invention, a pair of axle mounts 27 used to mount a wheel 40 include a "right-handed" and a "left-handed" mount 27 such that both mounts 27 are movable in the same direction to raise or lower the wheel 40. The present invention contemplates a simple handtool having a pair of spaced arm members which engage the boss 34 in conventional wrench fashion and provide for quick adjustment of the height of a wheel 40 at one end of an assembly 15. In addition to quick and easy operation, the present invention includes the advantage of independent height adjustments of each wheel 40 with the result that the main body 11 can be "tilted" or "raked" as desired in the circumstances. All of the parts of the wheel assembly are made of the appropriate water resistant materials such as nylon and other plastic materials.

Figure 4:
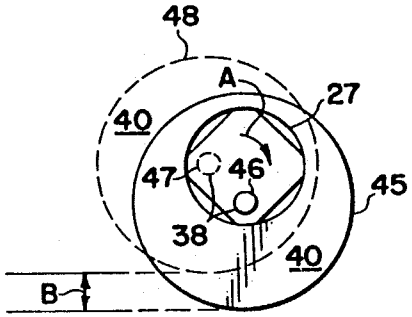
FIG. 4 is a simplified pictorial diagram illustrating operation of the height adjustment apparatus.

FIG. 4 is a simplified pictorial diagram showing the movement of wheel 40 from solid line position 45 with axle 38 at position 46 to position the wheel 40 at broken line position 48 by rotating the axle mount 27 in the direction of the arrow "A" to position axle 38 to broken line position 47. Distance "B" represents the amount by which the assembly 15 would be lowered by the described operation.

From the discussion hereinabove it is clear that the present invention lends itself to retrofit on existing vacuum apparatus. There are any number of methods by which the axle mounts 27 can be mounted to an arm member of a conventional cleaning head. In this regard it is important to understand that the locking means employed in the present invention involves cooperating notches, which are rotatable, and a single tab, which is stationary. The essential features of the selective locking means can be accomplished using variations on the theme.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An adjustable height assembly for pool vacuum apparatus having a body and a plurality of wheels carried by the body for supporting the bottom surface of the body a selected distance above a bottom surface of a pool, said assembly comprising wheel mounting means for mounting each said wheel to said body, said mounting means including an axle having opposite end portions for carrying said wheel therebetween and movable axle mounting means for supporting said axle, selective locking means for mounting said axle mounting means to said body in a manner to selectively inhibit rotary movement of said axle mounting means from a selected position, said axle mounting means includes a pair of spaced axle mounts, each said axle mount being rotatable about a first axis and having a passageway therethrough having a centerline parallel to and spaced away from said first axis for carrying a respective said end portion of said axle for adjusting the position of a wheel with respect to the body by the rotation of a pair of said axle mounts.

2. The assembly as defined in claim 1 wherein said body includes a plurality of pairs of spaced arm members extending laterally outwardly therefrom, each said wheel being mounted between a corresponding said pair of spaced arm members.

3. The assembly as defined in claim 2 wherein each said arm member includes a second passageway therethrough, said axle mount being located in a respective said second passageway.

4. The assembly as defined in claim 3 wherein said selective locking means includes a tab and a plurality of cooperating notches, said tab being located on one of said axle mounts and said arm member and said notches being located on another of said arm members and said axle mounts.

5. The assembly as defined in claim 4 wherein said tab is located on said arm member and disposed inwardly in said second passageway, each said axle mount having a perimeter and said notches spaced thereon, said notches being sized to engage said tab therein to inhibit rotary movement of said axle mount in a selected position during rolling movement of said wheels.

6. The assembly as defined in claim 5 wherein each said arm member includes a deformably resilient portion located adjacent said tab for positioning said tab inwardly into a respective selected one said notch to inhibit rotary motion of a said axle mount from a selected position, said arm portion being deformable outwardly to allow disengagement of a said notch and said tab when said axle mount is forcibly rotated to another selected position.

7. The assembly as defined in claim 1 wherein each said axle mount includes a laterally extending boss protruding outwardly with respect to said body for the engagement of said axle mount for selective rotation thereof.

8. The assembly as defined in claim 1 wherein said selective locking means includes a first surface of said arm member and a second surface of said axle mount, said first and second surfaces including means for engagement therebetween to inhibit motion of one said surface with respect to another said surface.

9. An adjustable height assembly for pool vacuum apparatus comprigins a body with a lower surface and having a forward portion and a rearward portion, a plurality of spaced forward wheels and a plurality of spaced rearward wheels, said wheels having a circumferential surface and being carried by respective said forward and rearward portion of said body for supporting respective said forward and rearward portion of said lower surface a selected distance above a bottom surface of a pool, a plurality of wheel mounting means attached to respective said forward and rearward portion of said body for mounting each said wheel to said body, each said mounting means including an axle having opposite end portions with said wheel being located therebetween and selectively rotatable movable axle mounting means for supporting said axle and adjusting the portion of said wheel by rotation of said axle mounting means, and selective locking means for locating said axle mounting means to said body in a manner to selectively inhibit rotary movement of said axle mounting means from a selected position until another position is selected, said position being selectable to adjust the distance between said lower surface and said circumferential surface of respective said wheel when each said wheel is on a bottom surface of a pool.

10. An adjustable height assembly for pool vacuum apparatus comprising a body with a lower surface, a plurality of wheels having a circumferential surface and being carried by said body for supporting said lower surface a selected distance above a bottom surface of a pool, wheel mounting means attached to said body for mounting each said wheel to said body, said mounting means including an axle having opposite end portions with said wheel being located therebetween and movable axle mounting means for supporting said axle, and selective locking means for locating said axle mounting means to said body in a manner to selectively inhibit rotary movement of said axle mounting means from a selected position until another position is selected, said position being selectable to adjust the distance between said lower surface and said circumferential surface of respective said wheel when each said wheel is on a bottom surface of a pool, said axle mounting means includes a pair of spaced axle mount members, each said axle mount member being rotatable about a first axis and having a passageway therethrough with a centerline parallel to and spaced away from said first axis for carrying respective said end portion of said axle, each pair of said axle mount members being rotatable for adjusting the position of respective said wheel with respect to said body.

11. The assembly as defined in claim 10 wherein said body includes a plurality of pairs of spaced arm members extending laterally forwardly and rearwardly therefrom in the general direction of rolling movement of said body on said wheels, each said wheel being mounted between a corresponding said pair of spaced, arm members.

12. The assembly as defined in claim 11 wherein each said arm member includes a second passageway therethrough, said axle mount members being located in respective said second passageways.

13. The assembly as defined in claim 12 wherein said selective locking means includes a tab and a plurality of cooperating notches, said tab being located on one of said mount members and arm members, and said notches being located on another of said arm members and mount members.

14. The assembly as defined in claim 13 wherein said tab is located on each said arm member and disposed inwardly in said second passageway, each said axle mount member having a perimeter and said notches spaced thereon, said notches being sized to engage said tab therein to inhibit rotary movement of said axle mount in a selected position during rolling movement of said body on said wheels.

15. The assembly as defined in claim 13 wherein each said arm member includes a deformably resilient portion located adjacent said tab for positioning said tab inwardly into a respective selected said notch to inhibit rotary motion of a said axle mount from a selected position, said arm portion being deformable outwardly to allow disentanglement of a said notch and said tab when said axle mount is forcibly rotated to another selected position.

16. An adjustable height assembly for the wheels of a pool vacuum comprising a body carried on a plurality of spaced axles, a plurality of pairs of spaced apart arm members secured to said body and extending forwardly and rearwardly thereof, elongated axle members having opposite end portions sized for the mounting of respective said wheels thereon between said opposite end portions and between a pair of respective said spaced arm members, a pair of axle mounts each having an axis for carrying each said axle, each said axle mount being secured to respective said end portion of said axle about which said axle mount may be rotated, means for rotatably mounting each said axle to respective said arm member, said axle having a rotatable axis parallel with and spaced away from said axis of said axle mount, said means for rotatably mounting said axle including selective locking means for securing said axle mount in a selected position to inhibit rotation of said axle mount during rolling movement of said body on said wheels.

17. The assembly as defined in claim 16 wherein said selective locking means includes a tab and a plurality of cooperating notches, said tab being located on one of said mount members and arm members, and said notches being located on another of said arm members and mount members.

18. The assembly as defined in claim 17 wherein each said arm member includes a second passageway therethrough, said axle mount members being located in respective said second passageways.

19. The assembly as defined in claim 18 wherein said tab is located on each said arm member and disposed inwardly in said passageway, each said axle mount member having a perimeter and said notches spaced thereon, said notches being sized to engage said tab therein to inhibit rotary movement of said axle mount in a selected position during rolling movement of said body on said wheels.

20. The assembly as defined in claim 19 wherein each said arm member includes a deformably resilient portion located adjacent said tab for positioning said tab inwardly into a respective selected said notch to inhibit rotary motion of a said axle mount from a selected position, said arm portion being deformable outwardly to allow disentanglement of a said notch and said tab when said axle mount is forcibly rotated to another selected position.

* * * * *